US012359821B2

(12) United States Patent
Veronese

(10) Patent No.: US 12,359,821 B2
(45) Date of Patent: Jul. 15, 2025

(54) FLAME CONTROL DEVICE FOR BURNERS

(71) Applicant: SIT S.P.A., Padua (IT)

(72) Inventor: Andrea Veronese, Abano Terme (IT)

(73) Assignee: SIT S.P.A., Padua (IT)

( * ) Notice: Subject to any disclaimer, the term of this patent is extended or adjusted under 35 U.S.C. 154(b) by 378 days.

(21) Appl. No.: 17/809,849

(22) Filed: Jun. 29, 2022

(65) Prior Publication Data

US 2023/0003389 A1 Jan. 5, 2023

(51) Int. Cl.
*F24C 3/12* (2006.01)

(52) U.S. Cl.
CPC ..... *F24C 3/122* (2013.01)

(58) Field of Classification Search
CPC ..... F24C 3/122
USPC ..... 431/18–90; 700/274
See application file for complete search history.

(56) References Cited

U.S. PATENT DOCUMENTS

2020/0400312 A1* 12/2020 Huang ..... F23N 5/102
2021/0080112 A1 3/2021 Vakdrak et al.

FOREIGN PATENT DOCUMENTS

JP H04101664 A 4/1992
JP 2015121372 A 7/2015

OTHER PUBLICATIONS

Raman (https://www.instructables.com/Current-Pulsing-Keeps-Power-Bank-Active/#ible-comments).*
Search Report for Application No. IT 202100017378, Feb. 17, 2022, 36 pages.

* cited by examiner

*Primary Examiner* — Vivek K Shirsat
(74) *Attorney, Agent, or Firm* — Stetina Garred Brucker & Newboles

(57) ABSTRACT

The invention relates to a flame control device for managing the operation of a gas burner apparatus, comprising:

an input prepared to receive a supply signal, an output intended to be connected to said gas burner apparatus, a control unit connected to said input to be supplied by the supply signal and to said output to control the operation of said burner by means of at least one output signal, a load configured to be controlled by the control unit so as to absorb power in a varying manner over time when said input is supplied by the supply signal.

13 Claims, 3 Drawing Sheets

FLAME CONTROL DEVICE FOR BURNERS

TECHNICAL FIELD

The present invention relates to a flame control device of the type generally used for igniting and/or detecting a flame on a burner, in particular a gas fireplace.

TECHNOLOGICAL BACKGROUND

The device according to the invention is particularly, although not exclusively, applied in the field of flame circuits, i.e., of the electronics usually used for controlling combustion in gas burners, in particular fireplaces. Controlling the opening/closing of gas delivery valves, generating the ignition spark, detecting the flame are examples of operations performed by such a type of circuits.

Flame circuits are generally supplied by the network voltage by means of specific AC/DC converters. In case of the absence of voltage, the burner is not capable of operating. To overcome this drawback, it is known to use common or rechargeable battery systems capable of buffering the temporary absence of network voltage.

The main drawback of said systems is the decreased autonomy and the need to replace the batteries once they are depleted.

On the other hand, very efficient devices are available today, referred to as USB power banks, i.e., buffer batteries which can be interfaced through a USB port, conventionally used to supply smartphones and other portable devices when the main battery is depleted or being depleted.

These devices have the feature of delivering power to the assisted device only as long as an absorption exceeding an expected value is detected. The delivery of power is interrupted below such a threshold, and a power save mode which can only be manually reset is activated.

For these reasons, USB power banks on the market are not adapted to supplying low consumption devices such as flame circuits because they do not have sufficient absorption to activate the power bank and avoid the power save mode, with subsequent switching OFF.

It is a remedy for using these devices in low absorption systems to add a constant/passive load (bleeder) to simulate the minimum load required by the external backup device. On the other hand, this results in a useless expenditure of energy which limits the autonomy of the device.

DESCRIPTION OF THE INVENTION

It is the object of the present invention to provide a flame control device for burners, in particular fireplaces, which is also capable of operating in the absence of a power grid in an efficient and practical manner.

The invention achieves the object with a flame control device for managing the operation of a gas burner apparatus, comprising:

- an input prepared to receive a supply signal,
- an output intended to be connected to said gas burner apparatus,
- a control unit connected to said input to be supplied by the supply signal and to said output to control the operation of said burner by means of at least one output signal,
- a load configured to be controlled by the control unit so as to absorb power in a varying manner over time when said input is supplied by the supply signal.

By virtue of this, the device can be supplied by means of a USB power bank, or in any case with any buffer device capable of delivering energy only when a given absorption threshold is exceeded without significantly increasing the energy consumption, and therefore, the autonomy of the device itself. Indeed, by acting on the load, i.e., providing a sort of intelligent bleeder, intermittent extra-absorption peaks sufficient to simulate the minimum load required by the backup device can be ensured so that the latter does not interrupt the delivery even if the average consumption is considerably lower than the permanent load one.

According to an advantageous improvement including the use of a voltage measurement circuit connected to the device input, it is then possible to activate the extra consumption only when an input supply voltage is detected in the range provided by the USB standard so that a decreased consumption for the operation in combination with normal batteries or a network power supply can be at least partially preserved.

Thereby, the flame control device can be supplied by means of a simple USB port connected to any device capable of delivering a voltage which falls within the operating specifications of the electronic components of the flame control device circuits.

Further features are defined in the sub-claims.

BRIEF DESCRIPTION OF THE DRAWINGS

The features and further advantages of the invention will become more apparent from the following detailed description of preferred, although not exclusive, embodiments thereof, which are described, by way of indicative and non-limiting example, with reference to the accompanying drawings, in which.

PREFERRED EMBODIMENTS OF THE INVENTION

Figure 1:
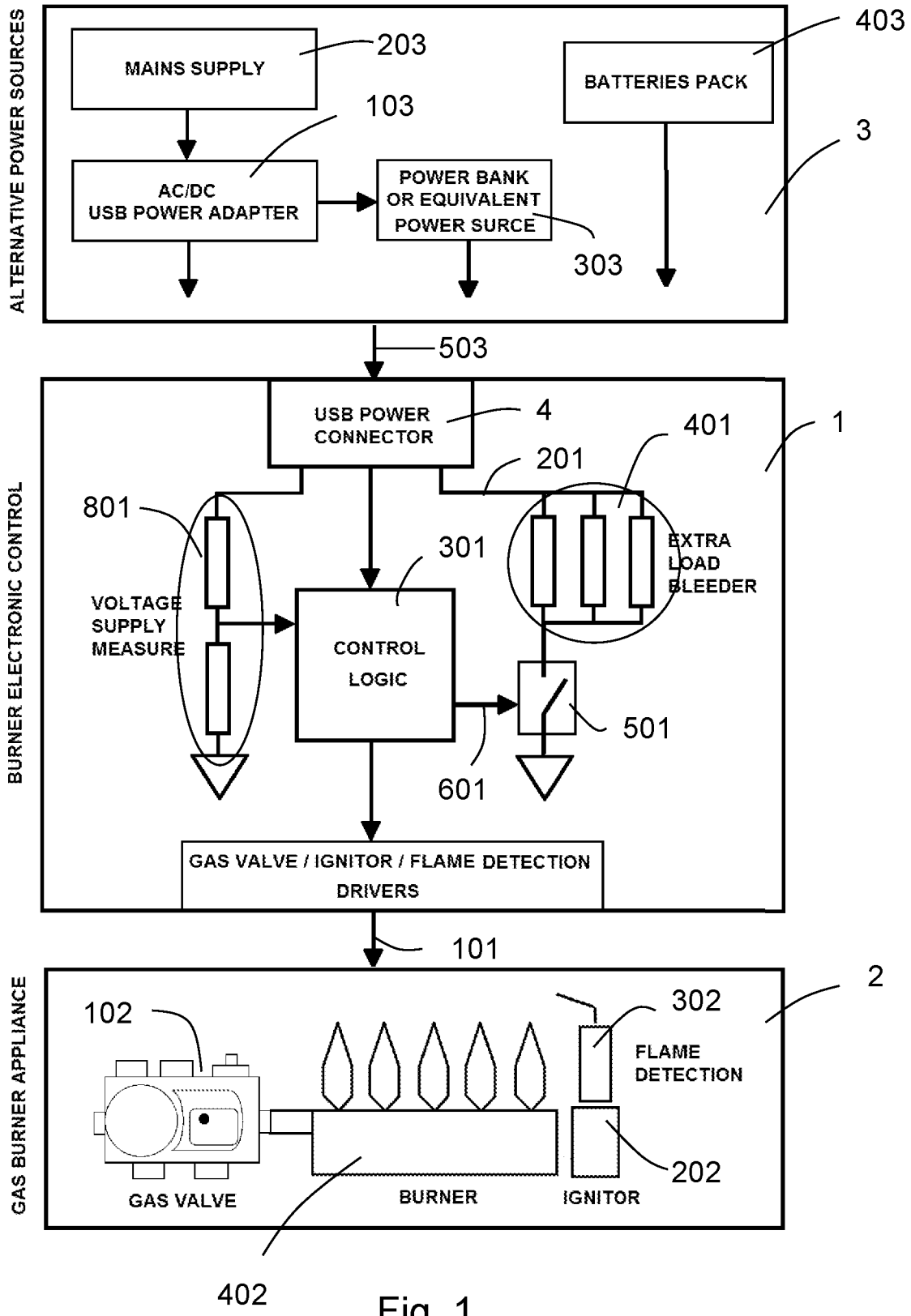
FIG. 1 shows a block diagram of a flame control device according to an embodiment of the invention. The device is shown interfaced with a supply device and a burner.

With reference to FIG. 1, a flame control device for managing the operation of a gas burner apparatus is indicated as a whole by numeral 1. The device in the drawing is shown interfaced with the burner, indicated by numeral 3, and a supply device, indicated by numeral 2.

By virtue of the use of a control logic 301, conventionally implemented by a microprocessor or microcontroller control unit, device 1 generates the signals 101 for operating various devices commonly present in burners, such as for example those intended to open/close gas delivery valves 102, generate the ignition spark 202, and detect the flame 302, which are shown in the drawing.

The generation of the supply voltage 201 in conventional flame control devices is conventionally entrusted to dedicated external power supplies, possibly buffered with batteries or backup cells to obviate any network absence.

By virtue of the contrivances implemented in the present invention, supplying the flame control device 1 can be indistinctly entrusted to dedicated power supplies, with or without buffer batteries, as well as to devices referred to as power banks, i.e., electronic backup devices capable of delivering current when the absorptions exceed a given minimum threshold.

For this purpose, in order to better take advantage of the devices available on the market; in a particularly advantageous embodiment, device 1 includes using a USB connector 4 by means of which to receive the supply signal.

Thereby; the supply can be provided by any type of USB power supply such as, for example those commonly used for supplying smartphones, including power banks.

To allow the operation of device 1 with a power bank, the invention includes using a load controlled by the control unit 301 so that it absorbs power in a varying manner over time. Thereby, the power bank detects a sufficient load to allow the activation thereof while ensuring a low consumption and therefore an increased operating autonomy.

Such a modulation of the absorbed power can advantageously be provided by alternately activating/deactivating a load 401 consisting of a fixed impedance, for example provided by a battery of parallel resistors, by means of a switch device 501 based on a control signal generated by the control unit 301, for example a rectangular wave signal with predetermined duty cycle.

In the specific configuration shown in FIG. 1, load 401 and the switch device 501 are arranged in series between input 201 and ground with the switch device 501 which is operable to be opened/closed by the control unit 301 so as to prevent/allow the passage of current between input and ground through load 401 when input 201 is supplied by the supply signal.

The control unit can thus cause the average value of the input impedance of the device to be greater than or equal to a predetermined value, ensuring that any possible supply by means of a power bank or similar operating threshold device is capable of operating.

The switch device 501 conventionally is a transistor, a preferably a Mosfet. In the configuration shown in FIG. 3, it is an N-channel Mosfet, having the Gate terminal connected to the control unit 301 so that the control signal 601 is applied to the Gate terminal. The Drain terminal is connected to a terminal of load 401, while the Source terminal is set to ground.

Connecting the other terminal of load 401 to input 4, when the input signal 201 supplies load 401 and the control signal 601 (in the present description also referred to as Bleeder_Enable) takes the high voltage level, voltage $V_{GS}$ between the Gate and Source terminals is greater than the threshold voltage $V_T$ of transistor 501, and a current passage $I_D$ is obtained between the Drain terminal and the Source terminal and therefore, between input 201 and ground.

Thereby, by varying the duration of the high signal with respect to that of the low signal, i.e., the signal duty cycle, an absorption can be set having a lower average value than a simple passive bleeder circuit, i.e., consisting of only resistors.

The table below shows an example of the absorptions which can be obtained with a load control cycle when the Bleeder_Enable signal 601 takes a high level (ON) and a low level (OFF), with the times indicated.

| Bleeder_Enable | Period (s) | Current (mA) |
|---|---|---|
| ON | 0.36 | 180 |
| OFF | 4.98 | 1 |

Obviously, multiple variants are possible. Indeed, the switch device 501 can be provided to be indifferently placed upstream or downstream of the load and to consist of any combination of passive components, whether they are in series or in parallel. It may also be provided for only one part of the load to be controlled by the switch device, while the remaining part be fixed, as in the case of splitter 701 shown in FIG. 1.

Another possibility may be given by using active commercial loads or more complex circuit configurations capable of ensuring the presence of extra currents while keeping low average absorptions.

Thereby, possible backup devices of the power bank type, USB in particular, can be used to supply the flame control device according to the invention.

Since it may be advantageous to connect the device to network supply sources or buffer batteries or cells in addition to the power bank, the invention optionally includes using a circuit capable of detecting the type of supply connected to the device and correspondingly deactivating the active load when it is not associable with a power bank.

For this purpose, an embodiment of the invention includes using a voltage measurement circuit 801 connected to input 4 and to the control unit 301. The control unit 301 is configured to detect the supply signal voltage value at the input 4 by means of the voltage measurement circuit 801 so as to deactivate the load 401 if the voltage value of the detected supply signal falls within a typical range of power supplies or buffer batteries/cells.

Figure 2:
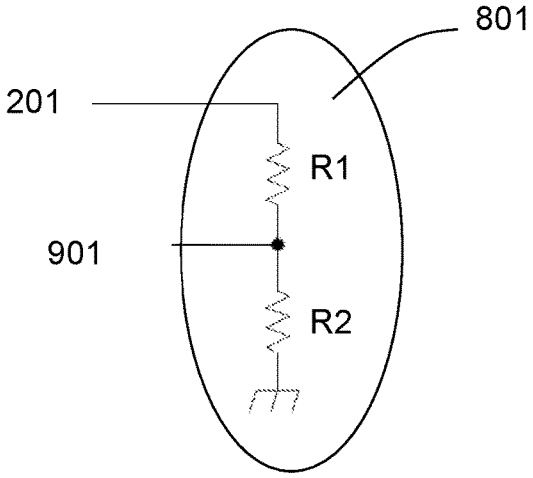
FIG. 2 shows the electric circuit of a possible circuit to be used for measuring the input voltage to the device in FIG. 1.

The simplest measurement circuit is shown in FIG. 2, i.e., a voltage splitter 801 with intermediate socket connected to an input 901 of the control unit provided with an analogue to digital converter. If the control unit has no converters therein, an external converter or other component or dedicated circuit can easily be used for the purpose based on the knowledge of those skilled in the art.

Figure 5:
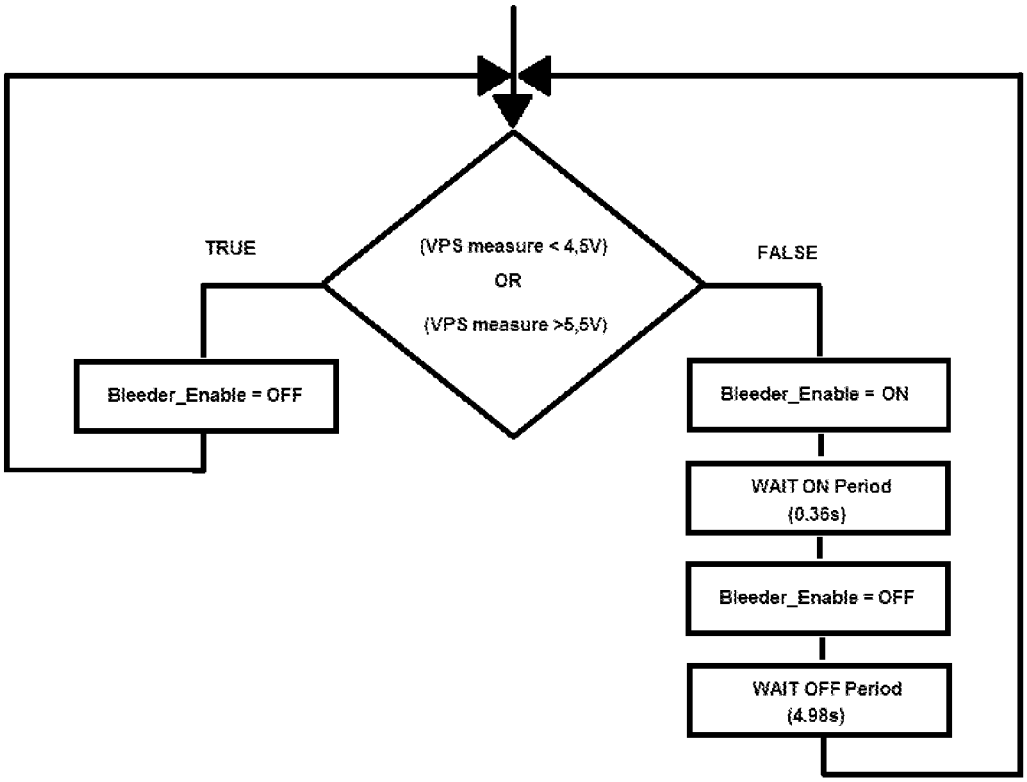
FIG. 5 shows an example of flow diagram of the control logic for managing the extra absorption of the device according to the invention.

By measuring the input voltage, the control unit 301 is capable of detecting the supply source type and consistently operating on the active load. An example of the steps carried out by the control logic is shown in FIG. 5. The control unit measures the input voltage and verifies whether it is, for example, in the conventional operating range of USB devices, 4.5 V-5.5 V. If the voltage falls outside this range, the supply comes from a power supply or a cell/battery whereby there is no need to activate the active load. Therefore, the Bleeder_Enable signal 601 is set to low level (left side of the flow diagram in FIG. 5) and the switch device 501 remains open, thus preventing the circulation of current from the supply to ground through load 401.

If the measured voltage fails instead within the identified range, the flow on the right of the drawing is performed, i.e., a square wave Bleeder_Enable signal 601 is generated, introducing idle standby cycles between a Bleeder_Enable ON and Bleeder_Enable OFF command. In the example shown in the drawing, such cycles correspond to 0.36 ms and 4.98 ms, respectively, as seen above. Obviously, other values, i.e., different duty cycles, can be set according to the average current value to be obtained on the active load.

Figure 3:
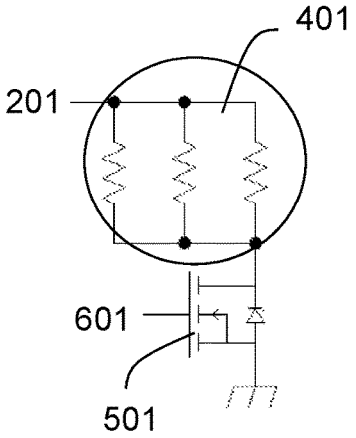
FIG. 3 shows the electric circuit of a possible active load to be used in the device in FIG. 1, for simulating intermittent extra absorption peaks.
Figure 4:
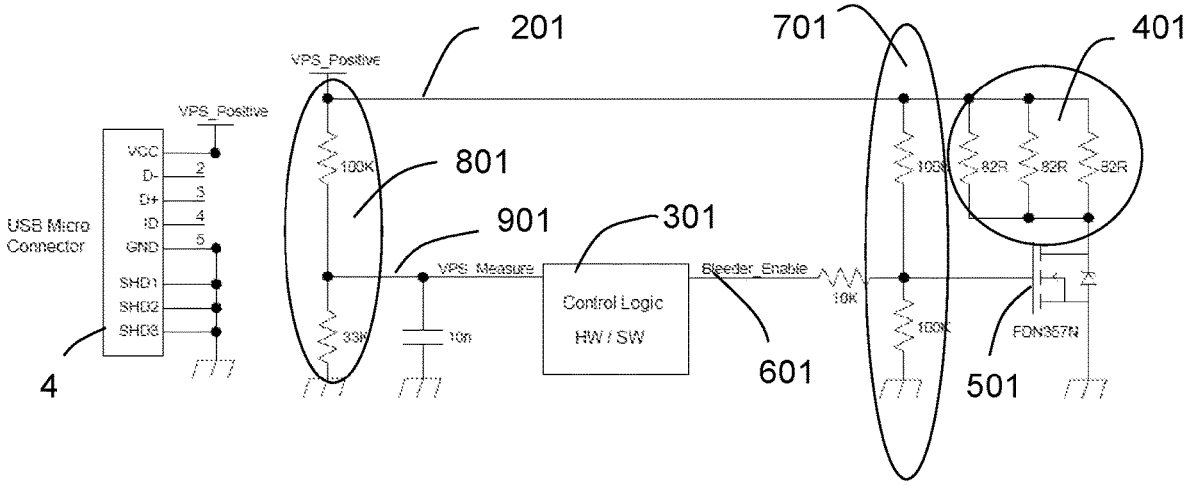
FIG. 4 shows the circuits of the preceding drawings, interfaced with the burner flame control logic.

FIG. 4 shows a circuit diagram which includes both the active load 401, 501 in FIG. 3 and the input voltage measurer 801 in FIG. 2. Obviously, the input voltage measurer circuit 801 is completely optional and can be omitted from the diagram.

A USB connector 4, for example of the micro type, completes the circuit and can be used to directly interface the device according to the invention with a USB source. This may be a power supply 103 connected to the power grid 203, a power bank 303 or a cell pack or batteries 403, as shown in FIG. 1. These components can be interchangeable or co-exist in the same supply device 3. For example, the power bank 303 can be connected to both the power supply 103 and the output USB port 503 so as to operate in the absence of a network voltage and simultaneously be recharged when instead there is such a voltage. More complex configurations may include using cells/buffer batteries in said supply device 3 or to be connected to auxiliary ports.

According to an embodiment of the invention, the control device 1 described above is provided in combination with a burner, in particular a gas fireplace. With reference to FIG. 1, the gas burner 2 comprises a main burner 402, gas delivery valves 102, an ignition spark generator 202, and a flame detector 302.

The invention claimed is:

1. A flame control device for managing the operation of a gas burner apparatus, comprising:

an input prepared to receive a supply signal, an output intended to be connected to said gas burner apparatus, a control unit connected to said input to be supplied by the supply signal and to said output to control the operation of said burner by means of at least one output signal, a load configured to be controlled by the control unit so as to absorb power in a varying manner over time when said input is supplied by the supply signal, and a voltage measurement circuit connected to said input and to said control unit, said control unit being configured to detect the voltage value of the supply signal at said input by means of said voltage measurement circuit.

2. A control device according to claim 1, wherein the load has a predetermined impedance, said control unit being configured to alternately activate/deactivate said load so that it absorbs power in a controlled manner when said input is supplied by the supply signal.

3. A control device according to claim 1, comprising a switch device which is operable by said control unit, said switch device being designed to activate and/or deactivate said load based on a control signal generated by said control unit.

4. A control device according to claim 3, wherein said control signal is a rectangular wave signal with predetermined duty cycle.

5. A control device according to claim 3, wherein the load and the switch device are arranged in series between input and ground, said switch device being operable to be opened/closed by the control unit so as to prevent/allow the passage of current between input and ground through the load when the input is supplied by the supply signal.

6. A control device according to claim 1, wherein said control unit is configured to act on the load so that the average value of the input impedance of the device is greater than or equal to a predetermined value.

7. A control device according to claim 1, wherein said input is connected to a power bank adapted to generate said supply signal.

8. A control device according to claim 1, wherein said control unit is configured to deactivate said load if the voltage value of the detected supply signal is less than a first value or greater than a second value.

9. A control device according to claim 1, wherein said input is provided with a USB port adapted to receive the supply signal.

10. A control device according to claim 9, characterized in that it is provided in combination with a supply circuit connected by means of the USB port, said supply circuit comprising a USB power bank.

11. A control device according to claim 9, wherein the supply circuit comprises a power supply which is connectable to the network voltage and/or one or more cells or buffer batteries capable of providing a voltage on the USB port.

12. A control device according to claim 1, characterized in that it is provided in combination with a gas burner, the output of the device being connected to at least one component of the burner selected from the group consisting of: flame detector, flame igniter, valve assembly for sending gas.

13. Gas fireplace comprising a control device according to claim 1.

* * * * *